US007331775B2

(12) United States Patent
Arbogast et al.

(10) Patent No.: US 7,331,775 B2
(45) Date of Patent: Feb. 19, 2008

(54) PUMPING DEVICE

(75) Inventors: Franz Arbogast, Heidenheim (DE); Peter Peiz, Heidenheim (DE)

(73) Assignee: Voith Turbo GmbH & Co. KG, Heidenheim (DE)

( * ) Notice: Subject to any disclaimer, the term of this patent is extended or adjusted under 35 U.S.C. 154(b) by 0 days.

(21) Appl. No.: 10/903,955

(22) Filed: Jul. 30, 2004

(65) Prior Publication Data

US 2005/0123419 A1 Jun. 9, 2005

(30) Foreign Application Priority Data

Jul. 31, 2003 (DE) ..... 103 34 954

(51) Int. Cl.
*F01C 1/10* (2006.01)
*F01C 21/00* (2006.01)
*F04B 17/00* (2006.01)

(52) U.S. Cl. ..... 418/169; 418/189

(58) Field of Classification Search ..... 417/410.4; 418/169, 189, 81
See application file for complete search history.

(56) References Cited

U.S. PATENT DOCUMENTS 2,544,144 A 3/1951 Freidel ..... 103/126
4,130,383 A * 12/1978 Moinuddin ..... 418/78
4,132,514 A * 1/1979 Eckerle ..... 418/71
6,089,841 A * 7/2000 Meernik et al. ..... 418/170
6,183,229 B1 * 2/2001 Friedmann ..... 418/170

FOREIGN PATENT DOCUMENTS

| | | |
|---|---|---|
| CH | 157744 | 12/1932 |
| DE | 15 53 014 A | 8/1969 |
| DE | 40 28 699 A1 | 4/1991 |
| DE | 41 33 880 A1 | 4/1993 |
| DE | 197 46 505 A1 | 6/1998 |
| DE | 199 34 035 A1 | 2/2000 |
| DE | 199 15 784 A1 | 10/2000 |
| DE | 101 34 622 A1 | 2/2003 |
| GB | 967944 | 8/1964 |
| JP | 62282185 | 12/1987 |

* cited by examiner

*Primary Examiner*—Charles G. Freay
(74) *Attorney, Agent, or Firm*—Ohlandt, Greeley, Ruggiero & Perle, L.L.P.

(57) ABSTRACT

A hydraulic pump is provided that reduces or eliminates unwanted noise, local pressure waves, pressure pulsations or cavitation and the like through use of pressure and suction chambers that are in substantial fluid isolation except for a backflow connection with a predetermined flow cross section to the suction chamber.

6 Claims, 3 Drawing Sheets

PUMPING DEVICE

RELATED APPLICATIONS

This application is related to, and claims priority in, German Patent Application DE 103 34 954.5, filed Jul. 31, 2003, the disclosure of which is incorporated herein by reference.

BACKGROUND OF THE INVENTION

1. Field of the Invention

The present invention relates to pumping devices and methods. More particularly, the present invention relates to hydraulic pumps and methods of hydraulic pumping.

2. Description of Related Art

Hydraulic pumps or hydro-pumps, are used to pump a hydraulic oil from a first pressure level to a second pressure level. These pumps often are supplied by, and deliver from, an oil tank in a closed circuit, so that the oil, after passing through the working section, is admitted back into the oil tank. The oil tanks are designed to be so large that they can accommodate an oil volume corresponding to three to five times the oil volume that is pumped by the pump per minute.

In operation, oil that was beforehand admitted into the tank often carries entrained air with it or air is entrained by the oil during admission of the oil into the tank. Due to the comparatively large tank, the supplied oil resides in the tank for a sufficiently long period of time before it is delivered out of the tank once again. During this residence period, the air entrained in the oil can rise to the surface. When the tank is designed to be correspondingly large, it is possible to ensure that the hydro-pump always draws in oil without entrained air.

However, entrained air is a problem with respect to mobile tanks. The mobile oil tanks are designed to be substantially smaller for reasons of cost and weight, which results in a shorter residence time of the oil in the tank. Due to this, contemporary hydro-pumps draw in foamed oil, that is, oil containing entrained air.

As a result of this unfavorable condition, the space available to the oil in the pressure buildup region of the hydro-pump is not filled completely with oil. Particularly in the case of gear pumps, it is not possible to bring the gear chambers in the reversing phase to the desired system pressure. When the pressure region is entered, the unfilled volumes—the only partially filled gear chambers for gear pumps—are abruptly filled. Local pressure waves are formed that lead to high pulsations. This leads to an extreme noise production and to damage to the structural parts owing to cavitation. Particularly in the pressure buildup region of hydro-pumps, traces of cavitation are repeatedly found.

Accordingly, there is a need to address the problems described above. There is a need for a hydraulic pump and method of hydraulic pumping that reduces or eliminates unwanted noise, local pressure waves, pressure pulsations or cavitation.

SUMMARY OF THE INVENTION

It is an object of the present invention to provide a hydraulic pump or hydro-pump where the pressure buildup relationships are designed in such a way that little or no excessive pressure pulsations arise and a low-noise, largely cavitation-free operation is possible.

The inventors have recognized an at once interesting and also unusual possibility for ensuring through constructional measures that only hydraulic medium that is nearly devoid of air enters into the pressure region in a hydro-pump. Conventional constructions are known to have narrow play relationships in the reversing region from the suction side to the pressure side in order to seal off the pressure chamber from the suction chamber as effectively as possible and to prevent a backflow of hydraulic medium out of the pressure chamber, because this would counter a pressure buildup in the pressure chamber. Small plays or gaps between parts that move relative to one another are regarded as necessary in order to achieve high volumetric degrees of efficiency.

By contrast, provided in accordance with the invention is the controlled adjustment of a volume flow of hydraulic medium out of the pressure chamber into the suction chamber. This is achieved in accordance with the invention by providing a backflow connection, carrying hydraulic medium and having a predetermined flow cross section, from the pressure chamber to the suction chamber. At the same time, the pressure chamber—with the exception of the backflow connection—is largely closed off in a pressure-tight manner from the suction chamber; that is, apart from the backflow connection that carries hydraulic medium, essentially no flow of hydraulic medium takes place from the pressure chamber into the suction chamber, and this results in the achievement of a high degree of efficiency.

Owing to the controlled backflowing volume flow in the case of a gear pump, for example, the only partially filled gear chambers are filled completely with hydraulic medium, particularly oil, up to entry into the pressure chamber and advantageously already have the desired system pressure. In this way, it is possible to prevent effectively a pressure pulsation due to the abrupt filling of air-filled volumes.

The desired backflowing volume flow from the pressure chamber into the suction chamber can be adjusted by means of an appropriate choice of the size of the connection cross section of the backflow connection. In particular, the size of the connection cross section from the pressure side to the suction side of the pump can be adjusted as a function of the air content of the hydraulic medium drawn into the suction chamber.

In one aspect, a pump for use with a hydraulic medium is provided, which has a pressure chamber, a suction chamber, a displacement device and a backflow connection. The suction chamber is in substantial fluid isolation from the pressure chamber. The displacement device is operably connected to the pressure and suction chambers. The displacement device causes the hydraulic medium to be pumped from the suction chamber into the pressure chamber. The backflow connection is in fluid communication with the pressure and suction chambers, and controls the volume of the hydraulic medium flowing between the suction and pressure chambers.

In another aspect, a pump is provided for use with a hydraulic medium. The pump has pressure and suction chambers, a displacement device, a backflow connection and a casing. The suction chamber is in substantial fluid isolation from the pressure chamber. The displacement device is operably connected to the pressure and suction chambers. The displacement device causes the hydraulic medium to be pumped from the suction chamber into the pressure chamber. The displacement device has first and second pinion gears engaged with each other. The backflow connection is in fluid communication with the pressure and suction chambers, and controls the volume of the hydraulic medium flowing between the suction and pressure chambers. The casing houses the first and second pinion gears. The pressure and suction chambers are formed between the first and second pinion gears and the casing. The casing at least partially defines the backflow connection.

In yet another aspect, a method of pumping a hydraulic medium is provided which includes, but is not limited to:

- providing a pressure chamber and a suction chamber that are in substantial fluid isolation;
- providing a displacement device having a displacement chamber that is operably connected to the pressure and suction chambers;
- providing a backflow connection that is in fluid communication with the pressure and suction chambers;
- driving the displacement device to cause flow of the hydraulic medium; and
- controlling volume of the hydraulic medium flowing from the suction chamber into the pressure chamber through use of the backflow connection by substantially completely filling the displacement chamber with the hydraulic medium to maintain a substantially uniform pressure in the displacement chamber.

The pump can have a pressure buildup region that has a higher pressure than another region of the pump, wherein the backflow connection is in the pressure buildup region. The displacement device may be an external toothed pinion gear eccentrically engaged with an internal toothed ring gear. The pump can also have a liner. The external toothed pinion gear and the internal toothed ring gear may define a sickle-shaped space therebetween, wherein the liner is in the sickle-shaped space and the backflow connection is along or through the liner.

The liner can have a surface having at least one channel formed therein, and the backflow connection may be defined at least in part by the at least one channel. The liner can have a first surface sealingly disposed adjacent to the external toothed pinion gear and a second surface sealingly disposed adjacent to the internal toothed ring gear. The at least one channel may be formed in either or both of the first and second surfaces. The at least one channel can be a notch in a circumferential direction of either or both of the first and second surfaces.

The liner can have first and second segments radially adjacent to each other, wherein the first and second segments can be displaced radially with respect to each other. The first and second segments may be displaced radially with respect to each other elastically. The first and second segments can be displaced radially with respect to each other by way of pressure in the sickle-shaped space.

The pump can have a casing that houses the external toothed pinion gear and the internal toothed ring gear, wherein the backflow connection is defined at least in part by the casing. The casing may have at least one surface, wherein at least one notch is formed in a circumferential direction of the at least one surface, and the backflow connection is at least partially defined by the at least one notch. The at least one surface of the casing can be sealingly disposed adjacent to an outer circumference of the internal toothed ring gear.

The first pinion gear can have first teeth and the second pinion gear can have second teeth. The first teeth may be sealingly engaged with the casing to define a first sealing surface, and the second teeth can be sealingly engaged with the casing to define a second sealing surface. The backflow connection may be between the first and second sealing surfaces. The casing may have a casing surface, wherein at least one channel is formed in the casing surface along either or both of the first and second sealing surfaces.

Adjusting the volume of hydraulic medium flowing may be done by varying a cross-sectional area of the backflow connection. Varying the cross-sectional area of the backflow connection can be based at least in part on air content of the hydraulic medium drawn into the suction chamber.

Other and further objects, advantages and features of the present invention will be understood by reference to the following:

DETAILED DESCRIPTION OF THE INVENTION

Figure 1:
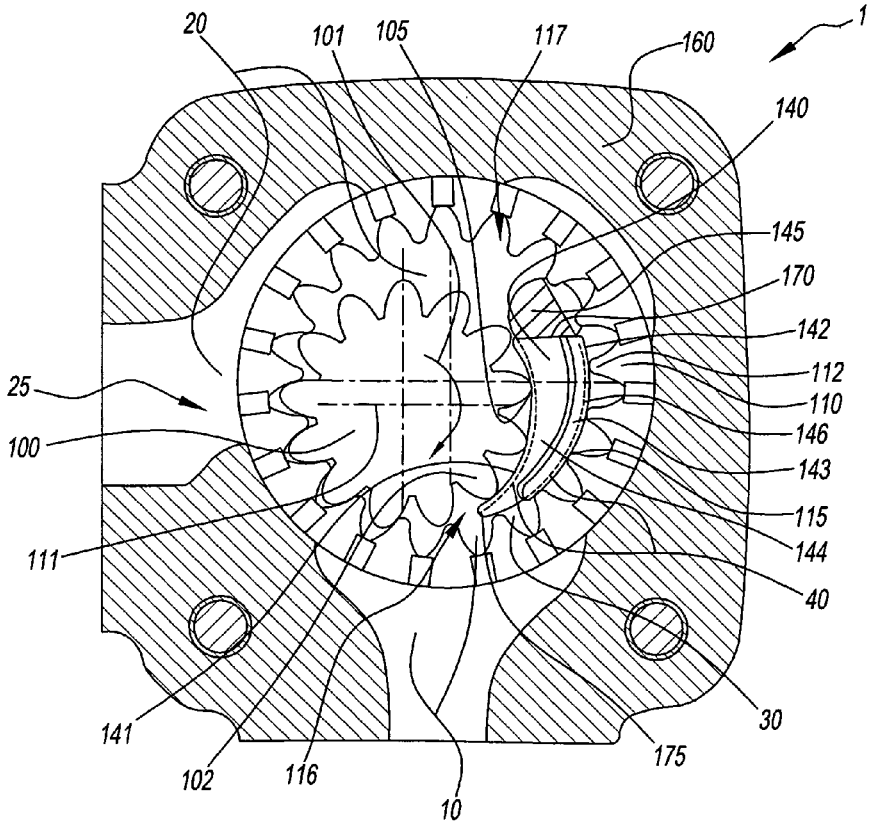
FIG. 1 is a cross-sectional view of an internal gear pump with a divided liner and with a backflow connection in accordance with the present invention.
Figure 2:
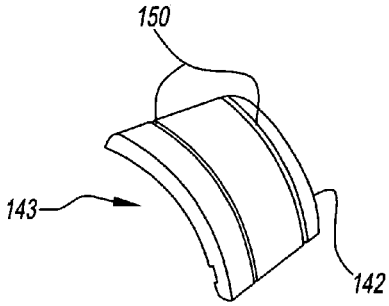
FIG. 2 is a perspective view of a first segment or member of the liner of FIG. 1.
Figure 3:
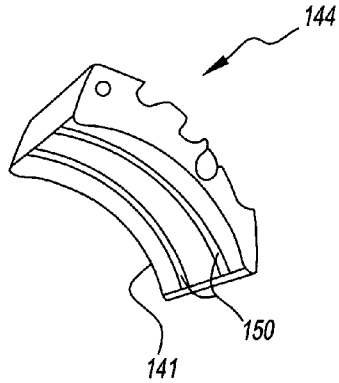
FIG. 3 is a perspective view of a second segment or member of the liner of FIG. 1.

Referring to FIGS. 1 through 3, an internal gear pump is shown and generally represented by reference numeral 1. The internal gear pump 1 has a pressure chamber 10, a suction chamber 20, and a displacement device, unit or member 25 having a displacement chamber 30. In the embodiment of pump 1, the displacement unit is an external toothed pinion gear 100 and an internal toothed ring gear 110, and the displacement chamber is partially defined by pressure and suction chambers 10 and 20. Pump 1 also has a liner 140.

The external toothed pinion gear 100 and the internal toothed ring gear 110 are engaged with each other in an intermeshing manner. As indicated by the dot-and-dashed central axes 111, the pinion gear 100 is mounted eccentrically in the ring gear 110. Due to this eccentric mounting, the pinion gear 100 and the ring gear 110 form a sickle-shaped space 115 between them. Inserted into this sickle-shaped space is the liner 140, which, on its front end or blunt side 170 rests against a pin 145. A pointed side 175 of the liner 140 is opposite the blunt side 170 and is adapted or corresponds in size and shape with the point or narrowed end 116 of the cross section of the sickle space 115 to fit therein with little play.

When driven, the pinion gear 100 rotates about its longitudinal axis as shown by arrow 101 and drives the ring gear 110. The ring gear 110 is rotatably mounted in a casing 160 that encloses the ring gear 110.

The liner 140 has two curved flat outer sides in the circumferential direction of the pinion gear 100 or of the ring gear 110, namely, a first surface 141 on the side of the pinion gear 100 and a second surface 142 on the side of the ring gear 110. The first surface 141 is mounted in close proximity to the tips of the teeth 102 of the pinion gear 100 and the second surface 142 is mounted in close proximity to the tips of the teeth 112 of the ring gear 110. This mounting results in the creation of a first sealing surface 105 between the pinion gear 100 and the first surface 141 and a second sealing surface 117 between the second surface 142 and the ring gear 110. These sealing surfaces 105 and 117, together with the intermeshing engagement between the pinion gear 100 and the ring gear 110, as well as the sealing surfaces that are represented between the ring gear 110 and the casing 160, seal off the pressure chamber 10 from the suction chamber 20.

In order to achieve a pressure-adapted optimal sealing effect of the two sealing surfaces 105 and 117 between the liner 140 and the pinion gear 100 or between the liner 140 and the ring gear 110, the liner is made up of two parts. The liner 140 comprises a sealing segment or member 143 and a support segment or member 144. The two sub-pieces, that is, the support segment 144 and the sealing segment 143, are arranged with respect to each other in a radially adjacent manner.

Provided between the two sub-pieces is a gap 146, which is connected with the pressure chamber 10 so as to convey pressure. The sealing segment 143 and/or support segment 144 can have various features that facilitate formation of the gap 146. Corresponding to the pressure in the gap 146, the two sub-pieces, sealing segment 143 and support segment 144, have a radial position with respect to each other so as to optimize the plays at the first and second surfaces 141 and 142 depending on the pressure relationship. The gap 146 can also be controlled by other structures and/or methods such as, for example, elastically.

Provided in the surfaces 141 and 142 are channels 150, which form the backflow connection 40 of the invention between the pressure chamber 10 and the suction chamber 20. As clearly shown in FIGS. 1 through 3. backflow connection 40 is in continuous fluid communication with the pressure chamber 10 and suction chamber 20 by notch-shaped channels 150 extending through liner 140. As can be seen particularly in FIGS. 2 and 3, two parallel notch-shaped channels 150 are formed in each surface 141 and 142. Although the present invention contemplates the use of other types of channels and/or fluid communication structures to form the backflow connection 40.

The hydraulic pump 1 reduces or eliminates unwanted noise, local pressure waves, pressure pulsations or cavitation and the like through use of pressure and suction chambers 10 and 20 that are in substantial fluid isolation except for backflow connection 40 with a predetermined flow cross section to the suction chamber. The desired backflowing volume flow from the pressure chamber into the suction chamber can be adjusted by means of an appropriate choice of the size of the connection cross section of the backflow connection 40. In particular, the size of the connection cross section from the pressure side to the suction side of the pump 1 can be adjusted as a function of the air content of the hydraulic medium drawn into the suction chamber 20.

Figure 4:
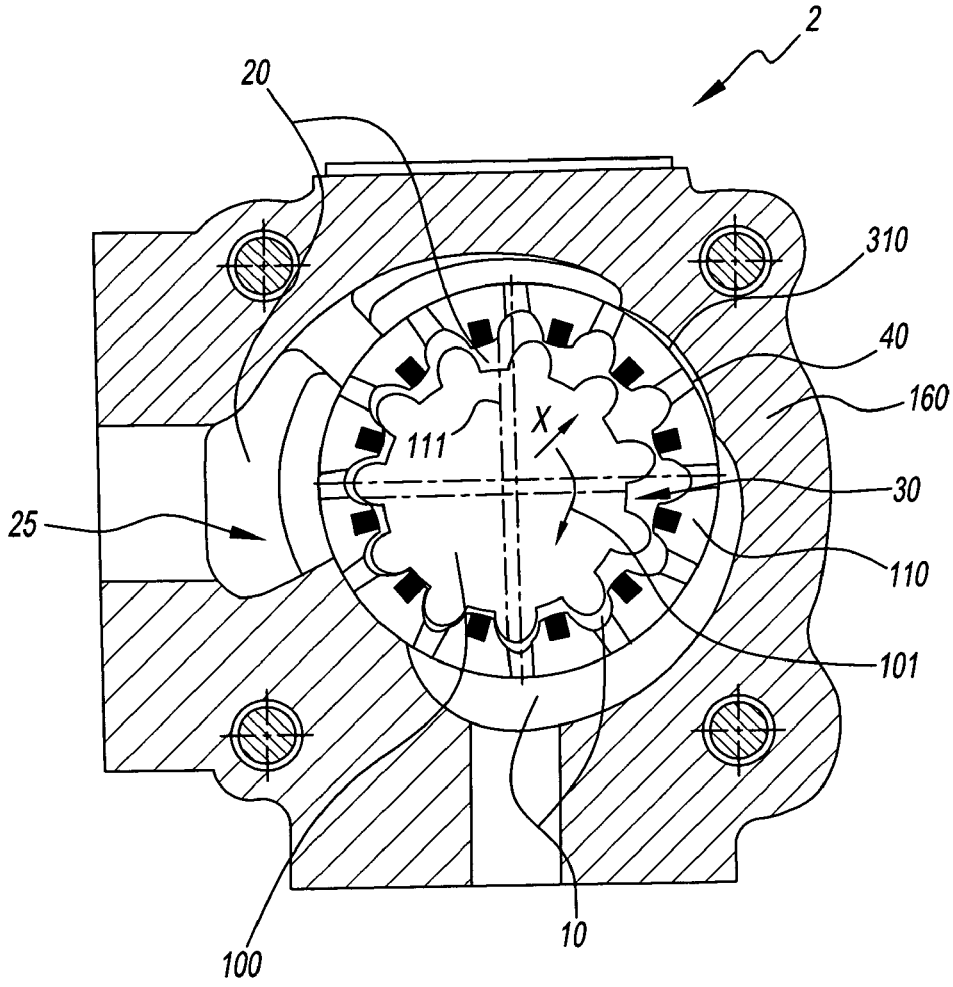
FIG. 4 is a cross-sectional view of another embodiment of an internal gear pump with a backflow connection.
Figure 5:
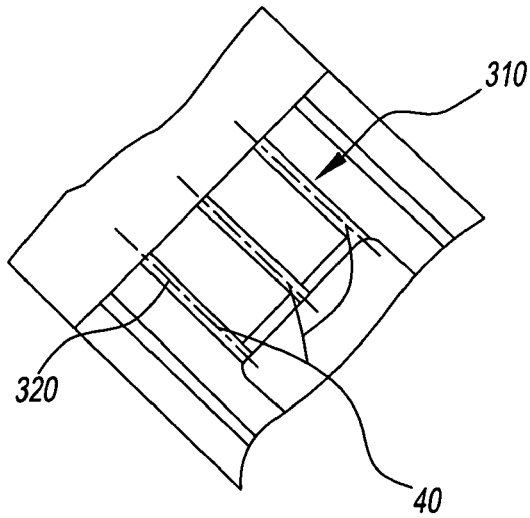
FIG. 5 is a plan view of the backflow connection of FIG. 4.

Referring to FIGS. 4 and 5, an alternative embodiment of an internal gear pump of the present invention is shown and generally represented by reference numeral 2. Corresponding parts between this embodiment and the embodiment of FIGS. 1 through 3, are provided with the same reference numbers.

In accordance with the pump 2, the backflow connection 40 is introduced into a sealing surface 310 between the ring gear 110 and the enclosing casing 160. In the embodiment shown, the casing 160 has notch-shaped channels 320 in the region of the surface between the pressure chamber 10 and the suction chamber 20 that is sealed off from the ring gear 110, which form the backflow connection 40. As is evident in the detail shown in FIG. 5, three parallel channels 320 are introduced into the inner lateral surface of the casing 160. However, the present invention contemplates the use of other numbers of channels 320, as well as other configurations, and/or other fluid communications structures, for forming backflow connection 40.

Through the backflow connection 40 introduced into the casing 160, hydraulic medium, such as, for example, oil, flows from the pressure chamber 10 in the direction of the suction chamber 20. Remaining space in the gear chambers, between gears 100 and 110, is filled essentially completely with hydraulic medium, particularly oil, via radial holes in the ring gear 110.

Figure 6:
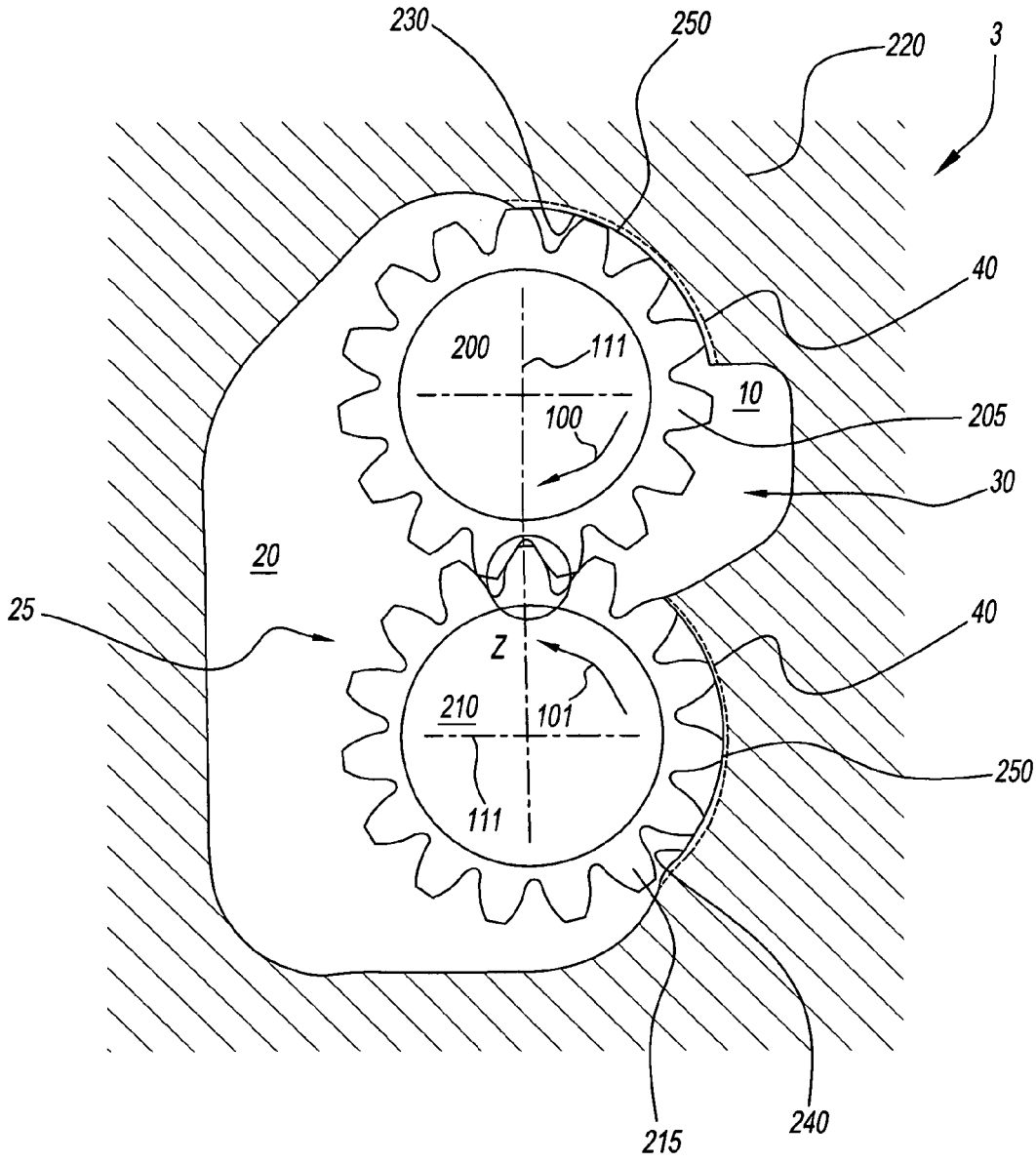
FIG. 6 is a cross-sectional view of an external gear pump with a backflow connection in accordance with the present invention.

Referring to FIG. 6, a gear pump of the present invention is shown and generally represented by reference numeral 3. Pump 3 is an external gear pump. Corresponding parts between this embodiment and the embodiments of FIGS. 1 through 3 and/or FIGS. 4 and 5, are provided with the same reference numbers.

Pump 3 has two intermeshing pinion gears 200 and 210. Gears 200 and 210 are enclosed by a casing 220. The pinion gear 200 forms, together with the casing 220, a first sealing surface 230. In this region, the tips of the teeth 205 of the pinion gear 200 have a predetermined minimal separation with respect to the inner surface of the casing 220.

The pinion gear 210 forms, together with the casing 220, a second sealing surface 240. In this region, the tips of the teeth 215 of the pinion gear 210 have a predetermined minimal separation from the inner surface of the casing 220.

The pressure chamber 10 is further separated in a sealed manner from the suction chamber 20, both of which are formed between the pinion gears 200 and 210 and the casing 220, by the intermeshing engagement between the pinion gears 200 and 210. The direction of rotation of the two pinion gears 200 210 is indicated by the arrow 101. The alignment axes of pinion gears 200 and 210 is shown by lines 111.

In accordance with this embodiment, both the first sealing surface 230 and in the second sealing surface 240, channels 250 are provided in the surface of the casing 220, which form the backflow connection 40. As clearly shown in FIG. 6. backflow connection 40 is in continuous fluid communication with the pressure chamber 10 and suction chamber 20 by channels 150 extending through the first sealing surface 230 and the second sealing surface 240. Alternatively, only one of the two sealing surfaces 230 or 240 is provided with corresponding channels 250 or with one channel. Alternative numbers and configurations of the channels 250, as well as the use of other fluid communication structures in forming the backflow connection 40, is contemplated by the present invention.

While the instant disclosure has been described with reference to one or more exemplary or preferred embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the appended claims.

What is claimed is:

1. A hydraulic pump with a pressure chamber and a suction chamber, the hydraulic pump comprising:

at least one displacement body, which is connected to be driven between the pressure chamber and the suction chamber, so that a hydraulic medium is pumped from the suction chamber into the pressure chamber, and from the pressure chamber, which is sealed off so as to be essentially pressure-tight from the suction chamber;

a hydraulic-medium-conducting backflow connection with a predefined flow cross section relative to the suction chamber, wherein the hydraulic pump is an internally toothed pump which has an externally toothed pinion and an internally toothed internal gear, and wherein the externally toothed pinion is arranged off-center in the internally toothed internal gear and is in meshing engagement therewith; and a filler being in a sickle-shaped space between the externally toothed pinion and the internally toothed internal gear, whereby the hydraulic-medium conducting backflow connection is inserted into the filler, so that it extends from the pressure chamber up to the suction chamber.

2. The hydraulic pump according to claim 1, wherein the hydraulic-medium conducting backflow connection is in the form of one or more channels in a surface of the filler.

3. The hydraulic pump according to claim 2, wherein the filler has a first surface which bears sealingly against a plurality of tooth tips of the externally toothed pinion and a second surface which bears sealingly against a plurality of tooth tips of the internally toothed internal gear, whereby a channel or plurality of channels in the first and/or second surface are in the form of notches in circumferential direction.

4. The hydraulic pump according to claim 1, wherein the filler is a two-part filler piece, whereby two pieces are arranged radially adjacent to one another and can be displaced radially relative to one another, elastically or by pressure-loading in the sickle space.

5. A hydraulic pump with a pressure chamber and a suction chamber, the hydraulic pump comprising:

at least one displacement body, which is connected to be driven between the pressure chamber and the suction chamber, so that a hydraulic medium is pumped from the suction chamber into the pressure chamber, and from the pressure chamber, which is sealed off so as to be essentially pressure-tight from the suction chamber; and a hydraulic-medium-conducting backflow connection with a defined flow cross section relative to the suction chamber, wherein the hydraulic pump is an internally toothed pump which has an externally toothed pinion and an internally toothed internal gear, wherein the externally toothed pinion is arranged off-center in the internally toothed internal gear and is in meshing engagement therewith, whereby the internally toothed internal gear is surrounded by a housing and the hydraulic-medium-conducting backflow connection is in the housing, and wherein the hydraulic-medium-conducting backflow connection is in the form of notches in a circumferential direction in one or more surfaces of the housing, whereby said one or more surfaces bear sealingly against an outer circumference of the internally toothed internal gear.

6. A hydraulic pump with a pressure chamber and a suction chamber, the hydraulic pump comprising:

at least one displacement body, which is connected to be driven between the pressure chamber and the suction chamber, so that a hydraulic medium is pumped from the suction chamber into the pressure chamber, and from the pressure chamber, which is sealed off so as to be essentially pressure-tight from the suction chamber; and a hydraulic-medium-conducting backflow connection with a defined flow cross section relative to the suction chamber, wherein the hydraulic pump is an externally toothed pump which has at least two pinions, which are in meshing engagement with one another, wherein the at least two pinions are surrounded by a housing, wherein the pressure chamber and the suction chamber are formed between the at least two pinions and the housing, wherein the hydraulic-medium-conducting backflow connection is inserted into the housing, whereby a first of the at least two pinions bears in a sealing manner with a plurality of tooth tips against the housing, so that a first sealing surface is formed and a second of the at least two pinions bears in a sealing manner with a plurality of tooth tips against the housing so that a second sealing surface is formed, and wherein the hydraulic-medium-conducting backflow connection is formed in a region of two sealing surfaces in the form of one or more channels in the housing surface.

* * * * *